US011261631B2

(12) United States Patent
Güzeltepe et al.

(10) Patent No.: US 11,261,631 B2
(45) Date of Patent: Mar. 1, 2022

(54) HINGE HAVING PINCH PROTECTION AND METHOD FOR DISPLACING SECURING PARTS OF A HINGE

(71) Applicant: Samet Kalip Ve Maden Esya San. Ve Tic. A.S., Istanbul (TR)

(72) Inventors: Nurettin Güzeltepe, Büyükçekmece/Istanbul (TR); Artur Hirtsiefer, Neunkirchen-Seelscheid (DE)

(73) Assignee: Samet Kalip Ve Maden Esya San. Ve Tic. A.S.

( * ) Notice: Subject to any disclaimer, the term of this patent is extended or adjusted under 35 U.S.C. 154(b) by 98 days.

(21) Appl. No.: 16/606,879

(22) PCT Filed: May 11, 2017

(86) PCT No.: PCT/TR2017/000051
§ 371 (c)(1),
(2) Date: Oct. 21, 2019

(87) PCT Pub. No.: WO2018/208240
PCT Pub. Date: Nov. 15, 2018

(65) Prior Publication Data

US 2021/0277693 A1 Sep. 9, 2021

(51) Int. Cl.
*E05D 7/00* (2006.01)
*E05D 3/18* (2006.01)
*E05D 7/04* (2006.01)

(52) U.S. Cl.
CPC ..... *E05D 3/18* (2013.01); *E05D 7/0407* (2013.01); *E05Y 2800/41* (2013.01); *E05Y 2900/20* (2013.01)

(58) Field of Classification Search
CPC ..... E05D 11/0054; E05D 2011/0063; E05D 2011/0072; E05D 3/18; E05D 3/183;
(Continued)

(56) References Cited

U.S. PATENT DOCUMENTS 1,546,556 A * 7/1925 Scheying ..... F27D 1/004 52/506.04
2,115,381 A * 4/1938 Caldwell ..... E05D 3/18 16/360

(Continued)

FOREIGN PATENT DOCUMENTS

AT 401954 B 1/1997
CH 608802 A 6/1971

(Continued)

OTHER PUBLICATIONS

International Search Report for Patent Application No. PCT/TR2017/000051, dated Jan. 15, 2018, 14 pages (not prior art).

(Continued)

*Primary Examiner* — Chuck Y Mah
(74) *Attorney, Agent, or Firm* — Lucian Wayne Beavers; Patterson Intellectual Property Law, PC

(57) ABSTRACT

The invention relates to a hinge for connecting two securing arts for directly or indirectly securing to two furniture parts pivotable relative to each other, the securing parts being pivotably connected to each other by means of a connecting assembly. It is thereby provided that a linear guide element is disposed on each of the two securing parts, said elements interacting to form a linear guide, and that the hinge comprises a guide device implemented for displacing the linear guide depending on the pivot position of the securing parts relative to each other.
The invention further relates to a method for displacing a first securing part of a hinge in an articulated manner relative to a second securing part.
The hinge and the method enable a pivotable connection between furniture parts having at least a reduced risk of injury.

16 Claims, 6 Drawing Sheets

(58) Field of Classification Search
CPC ..... E05D 3/122; E05D 1/00; E05D 7/0407; E05D 7/009; E05C 17/54; E05Y 2900/132; E05Y 2900/502; E05Y 2600/46; E05Y 2600/41; E05Y 2201/484; E05Y 2201/496; E05Y 2201/10; E05Y 2201/11; E05Y 2800/41; E05Y 2900/20; Y10T 16/533; Y10T 16/5335; Y10T 16/541; Y10T 16/542; Y10T 16/5388
See application file for complete search history.

(56) References Cited

U.S. PATENT DOCUMENTS 2,249,403 A * 7/1941 Stollsteimer ..... A47B 5/04 248/240.3
2,711,556 A * 6/1955 Magnuson ..... E05D 11/1007 16/327
2,777,157 A * 1/1957 Burke ..... E05F 1/1261 16/290
2,883,699 A 4/1959 Gross
3,414,933 A * 12/1968 Gronbach ..... E05F 1/1261 16/290
3,470,579 A * 10/1969 Cencioni ..... E05D 3/18 16/360
3,626,548 A 12/1971 Grunert
3,978,549 A * 9/1976 Vitt ..... E05D 3/183 16/245
4,411,046 A * 10/1983 Nawrath ..... E05D 3/183 16/354
4,736,491 A * 4/1988 Mertes ..... E05D 3/18 16/358
5,450,655 A * 9/1995 Ferrari ..... E05D 3/16 16/368
5,535,482 A * 7/1996 Grabber ..... E05D 3/022 16/286
6,925,682 B2 * 8/2005 Mueller ..... E05D 7/0407 16/236
7,530,142 B2 5/2009 Sutterluetti et al.
8,205,298 B2 * 6/2012 Lin ..... E05F 5/006 16/287
9,523,227 B1 * 12/2016 Huang ..... E05F 5/10
2008/0216289 A1 9/2008 Salice

FOREIGN PATENT DOCUMENTS

CN 101248244 A 8/2008
CN 205477016 U 8/2016
CN 106481178 A 3/2017
DE 3807729 A1 * 9/1989 ..... E05D 3/183
DE 102010011794 B3 5/2011
EP 1727954 A1 12/2006
EP 1766172 A1 3/2007
FR 2973426 A1 * 10/2012 ..... E05D 3/022
GB 847929 A 9/1960
GB 2541716 A 3/2017

OTHER PUBLICATIONS

China Search Report for corresponding patent application No. 2018103385860, dated Jun. 4, 2019,2 pages (not prior art).
India Office Action for corresponding patent application No. 201947044778, dated Sep. 10, 2020, 6 pages (not prior art).

* cited by examiner

HINGE HAVING PINCH PROTECTION AND METHOD FOR DISPLACING SECURING PARTS OF A HINGE

BACKGROUND OF THE INVENTION

Field of the Invention

The invention relates to a hinge for connecting two securing parts for directly or indirectly securing to two furniture components pivotable relative to each other, the securing parts being pivotably connected to each other by means of a connecting assembly.

The invention further relates to a method for displacing a first securing part of a hinge in an articulated manner relative to a second securing part, the first securing part being implemented for securing a first furniture part and the second securing part being implemented for securing a second furniture part.

Description of the Prior Art

Publication U.S. Pat. No. 2,883,699 discloses a hinge for a pivotable door. The hinge is secured to a door frame by means of a first securing element. The first securing element comprises a plate, a recess, and the door joint at the end. A second securing element connects the door to the door joint. The second securing element is implemented in two parts, having a plate for connecting to the door and an intermediate piece. The plate and intermediate piece are connected to each other by means of a joint. The joint is received in the recess when the door is closed. A spring is associated with the joint and holds the intermediate piece and the plate in linear alignment with each other. The door opens and closes by pivoting about the door joint. If a finger is pinched in door gap, then the joint displaces against the spring force so that the door gap expands. Injury is thereby avoided. A force defined by the spring is disadvantageously required for displacing the joint, and can increase greatly if the hinge parts are not precisely aligned to each other. Due to the comparatively large lever formed by the door, a high force can be transmitted to a pinched finger before the door gap enlarges accordingly and can lead to crushing the finger. A further disadvantage arises from the fact that the door is no longer retained in the desired position thereof after the joint has actuated. This can lead to the door striking adjacent wall or objects and causing damage.

A hinge having two joint parts for connecting two partial flaps of a folding flap is known from EP 1 727 954 B1, as used, for example, for closing off upper cabinets. When closed, the partial flaps lie in one plane, while when closed said flaps are disposed at an angle to each other in order to expose the interior of the cabinet. The joint parts are connected to mounting plates attached to the partial flaps. At least one joint part is thereby displaceably supported on a mounting plate, wherein said part is retained in a first position by a retaining device exerting force. If the retaining force is exceeded, the joint part can be displaced from the first position into a second position. While the partial flaps can be closed in the normal manner in the first position, in the second position of the displaceable joint part the partial flaps are spaced apart from each other so that an enlarged gap forms between the partial flaps. An injury of a finger, for example, pinched between the partial flaps of the folding flap can thereby be avoided. It is thereby disadvantageous that the joint part is displaceably supported on a rigid mounting plate directly connected to a partial flap. The result is a rigid, non-spring-loaded connection leading, in case of even a slight misalignment between the components of the hinge, to the force required for overcoming the retaining force being significantly greater than the desired force at which injury to a pinched finger can be reliably excluded.

EP 1 766 172 B1 discloses a lifting device for a two-winged folding flap. Two wings of the folding flap are connected to each other by a hinge in an articulated manner. The hinge comprises a hinge cup for inserting in one of the wings. A joint axis of the hinge is disposed in the hinge cup. A hinge arm forms the connection between the joint axis and the second wing of the folding flap. The joint axis is disposed in the hinge cup such that a gap formed between the wings is smaller than the thickness of a finger of a user throughout the entire motion sequence when opening and closing the folding flap, so that reaching through the gap is avoided. To this end, however, the joint axis must be disposed within the hinge cup between the inner and outer surfaces of the wing. The hinge must therefore comprise a hinge cup recessed in the wing, which is impossible or undesired for aesthetic reasons for many materials used for folding flaps, such as for glass.

SUMMARY OF THE INVENTION

The object of the invention is to produce a versatile hinge providing protection against injuries to a hand or finger due to pinching.

A further object of the invention is to provide a method for actuating a hinge with reduced risk of injury.

The object of the invention relating to the hinge is achieved in that a linear guide element is disposed on each of the securing parts and interact to form a linear guide, and that the hinge comprises a guide device implemented for displacing the linear guide depending on the pivot position of the securing parts relative to each other. The linear guide can be used for adjusting a gap present between the furniture parts joined to each other by the hinge in an articulated manner depending on the mutual pivot position of the securing parts. The gap can thereby be kept so small for all potential pivot positions of the two securing parts, and thus of the furniture parts, relative to each other, that reaching through with a hand or finger is safely prevented. The design of the narrow gap prevents a hand or a finger from being pinched between the furniture parts connected by means of the hinge, particularly when closing the hinge. The risk of injury for a user is thus significantly reduced. In contrast to known hinges having pinch protection, no detent connections or the like are opened in order to obtain an enlarged gap when a finger is pinched between the furniture parts. The functionality of the hinge thus remains continuously intact. The risk of injury, such as exists for a detent connection not correctly actuating in such known hinges, is eliminated by design.

Simple adjustment of the gap between the furniture parts depending on the pivot position of the securing parts relative to each other can be achieved in that a pivot bearing of the hinge is linearly displaceably disposed depending on the pivot position of the securing parts relative to each other. The pivot bearing forms the center of rotation of the hinge and thus the furniture parts relative to each other. By tracking the center of rotation, the relative position of the two furniture parts and thus the gap formed between the same can be adjusted.

It can be advantageously provided that the first securing part is directly or indirectly and pivotably connected to the first linear guide element disposed thereon. By displacing the first linear guide element, the center of rotation of the hinge can be linearly displaced and the width of the gap between the furniture parts can be adjusted. Simple and reliable displacing of the linear guide depending on the pivot position of the securing parts relative to each other can be achieved in that the guide device comprises a guide element or is formed by such an element each pivotably connected to the securing parts. The guide element is preferably implemented as a lever having a constant, unchangeable length. Because the guide element is pivotably connected to the securing parts, said element can follow the pivot motion thereof by means of a corresponding pivoting itself. Because the length of the guide element cannot change, said pivoting requires a change in the spacing between the two securing parts. The linear guide is thereby displaced depending on the angular displacement of the hinge.

According to a preferred embodiment variant of the invention, it can be provided that a first pivot axis by means of which the guide element is pivotably connected to the first securing part, is disposed spaced apart from a pivot bearing by means of which the first securing part is pivotably connected to the first linear guide element. The spacing between the first pivot axis and the pivot bearing defines the radius at which the first pivot axis is rotated about the pivot bearing and the pivot bearing is rotated about the first pivot axis in a superimposed motion. At the same time, the first pivot axis is guided according to the length of the guide element about the support thereof on the second securing part. The pivot motions brought about by actuating the hinge require a change in the spacing between the pivot bearing and the support of the guide element on the second securing part, whereby a corresponding linear displacement of the linear guide element is induced. The distance by which the linear guide is displaced for a given pivoting of the securing parts relative to each other thereby depends on the spacing between the pivot bearing and the first pivot axis. By suitably selecting the spacing between the pivot axis and the pivot bearing, the width of the gap formed between the furniture parts can be defined for various rotary positions of the furniture parts to each other.

The pivoting of the securing parts relative to each other and simultaneously linear displacement of the position of the pivot bearing can be made possible in that the first pivot axis, the first pivot bearing, and/or a second pivot bearing by means of which the guide element is pivotably connected to the second securing part are identically oriented.

It can preferably be provided that the first pivot axis is disposed pivotably about the pivot bearing.

In order to be able to ensure a sufficiently small gap width throughout the entire pivot range of the hinge, it can be provided that the securing parts are pivoted relative to each other in an extended position of the linear guide such that furniture parts mounted thereon are identically oriented, preferably in one plane, and that when the linear guide is retracted the securing parts are pivoted relative to each other such that furniture parts mounted thereon are oriented at an angle to each other.

It can particularly preferably be provided that the linear guide is oriented such that when the hinge is mounted on an item of furniture, said guide is oriented parallel or at least nearly parallel to the surface of the second furniture part connected to the second securing part. By displacing along the linear guide, the spacing between the two securing parts and thus of the furniture parts mounted thereon is changed in the direction of the gap width to be adjusted. Displacement transverse thereto is prevented, whereby the two furniture parts remain precisely oriented relative to each other.

It can be advantageously provided that the second securing part comprises a second mounting surface for bearing on the second securing part on the second furniture component, and that the first pivot axis is disposed on the side of the linear guide facing toward the second mounting surface and the second pivot axis is disposed on the side of the linear guide facing away from the second mounting surface. Said arrangement causes the guide element to intersect the displacement path of the linear guide. The pivot motion of the hinge at the same time as the linear displacement is thereby made possible. It is further achieved that the guide element enters into the gap formed between the furniture parts at a steep angle when the linear guide is retracted. The gap width can thereby be kept small.

Correct design of the gap formed between the furniture parts assumes precise positioning of the hinge relative to the furniture parts. This relates particularly to the positioning of the securing parts in the direction of the gap width and thus the displacement direction of the linear guide. In order to achieve such precise positioning, it can be provided that adjusting means, particularly elongated holes receiving securing means, are disposed on the first securing part and/or on the second securing part for displacing the position of the first securing part and/or of the second securing part in the direction of the linear guide. When installing the hinge, the gap can thus be adjusted to a specified value in a specified pivot setting of the hinge by means of the adjusting means. It is thereby ensured that the width of the gap does not exceed or drop below a desire maximum value or desire minimum value over the entire pivot range of the hinge.

If it is provided that the guide element comprises a contact surface for bearing on the first furniture part when the linear guide is retracted, then the pivot range of the hinge is limited in a defined manner in the direction of the folded-in position thereof.

The pivot range can be limited when the hinge is folded open in that the first linear guide element bears on the first securing part in an end position of the pivot range of the hinge when the linear guide is extended.

The object of the invention relating to the method is achieved in that a pivot bearing of the hinge is linearly displaced depending on the pivot position of the first securing part relative to the second securing part. The pivot bearing forms the center of rotation of the hinge and the connection between the securing parts and thus the furniture parts connected to the securing parts. By linearly displacing the pivot bearing, the spacing between the installed furniture parts can be changed. The gap formed between the furniture parts can thereby be adjusted. The dependence of the linear displacement on the pivot position means that the gap width can be defined for the potential pivot positions of the hinge. The width of the gap can thereby be set so small for all pivot positions of the hinge that it is impossible to reach through with a hand or a finger. The risk of injury for a user is thus significantly reduced by said measure.

A gap width remaining as constant as possible between the furniture parts over the entire pivot range of the hinge can be achieved in that the pivot bearing is disposed on the first securing element, in that when the securing elements are pivoted, leading to a planar orientation of furniture parts mounted thereon, the spacing between the pivot bearing and the second securing element is enlarged, and in that when the securing elements are pivoted, leading to a smaller angle between the furniture parts mounted on the securing elements, the spacing between the pivot bearing and the second securing element is reduced.

In order to be able to adjust the gap between the installed furniture parts and to retain the precise orientation of the furniture parts transverse to the gap width at the same time, it can be provided that when the hinge is installed the pivot bearing is displaced parallel to a surface of a second furniture part to which the second securing part is secured.

A unique relationship between the pivot position of the hinge and the linear positioning of the securing parts relative to each other can be achieved in that the position of the pivot bearing is linearly displaced by a mechanical coupling between the first and the second securing parts. This enables precise and reproducible adjusting of the gap width for the various pivot positions of the hinge.

Effective pinch protection can be achieved in that the pivot bearing of the hinge is linearly displaced depending on the pivot position of the first securing part relative to the second securing part, such that a width of a gap formed between the furniture parts displaceably connected to each other by means of the hinge is less than the thickness of a finger, particularly less than or equal to 6 mm, for all adjustable pivot positions of the hinge.

BRIEF DESCRIPTION OF THE DRAWINGS

The invention is explained in greater detail below using an embodiment example shown in the drawings. They show.

DETAILED DESCRIPTION

Figure 1:
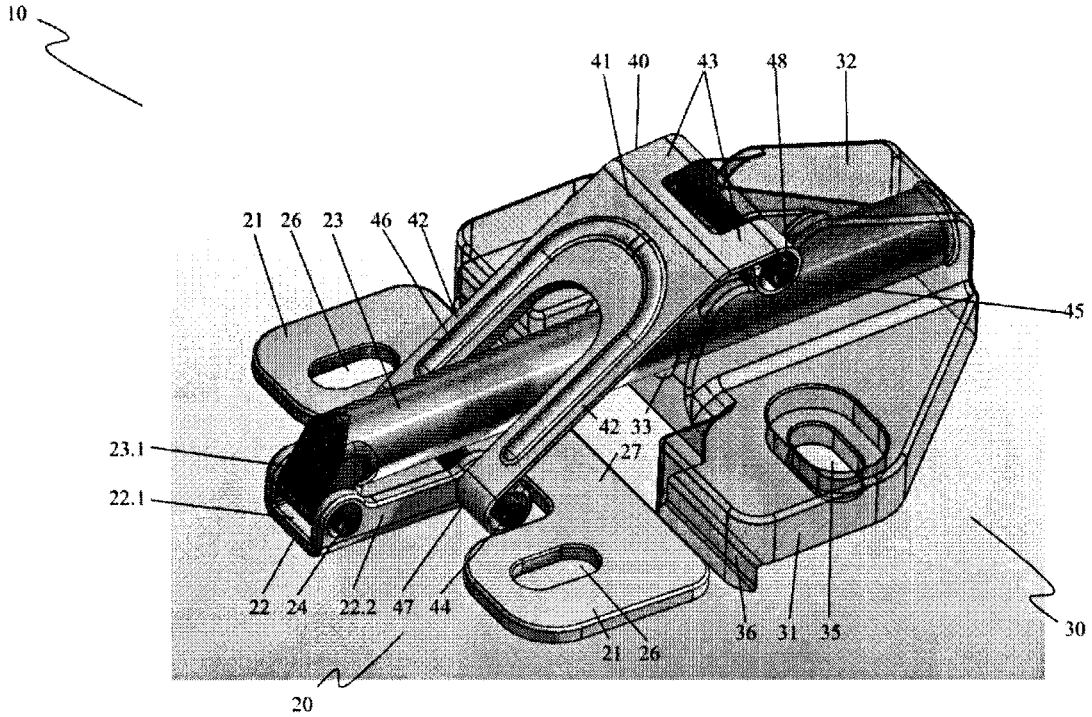
FIG. 1 A perspective view of a hinge having a linear guide in the extended position thereof, FIG. 2 A second perspective view of the hinge shown in FIG. 1 having the linear guide extended, FIG. 3 A side view of the hinge shown in FIG. 1 installed on a closed folding flap, FIG. 4 The hinge shown in FIG. 3 having the folding flap partially open, FIG. 5 The hinge shown in FIGS. 3 and 4 having the folding flap opened further, and FIG. 6 The hinge shown in FIGS. 3, 4, and 5 having the folding flap opened completely.

FIG. 1 shows a perspective view of a hinge 10 having a linear guide in the extended position thereof.

A first and a second securing part 20, 30 are associated with the hinge 10. The first securing part 20 comprises a connecting segment 27 on the sides of which flanges 21 are formed. A cantilever 22 is preferably further integrally connected to the connecting segment 27. The connecting segment 27 and the side flanges 21 are flat in design. An elongated hole 26 is formed in each of the side flanges 21. The elongated holes 26 are oriented in the direction toward the second securing part 30. The cantilever 22 is U-shaped in design. Said cantilever comprises a floor 22.1 and side walls 22.2 formed at an angle on opposite edges of the floor 22.1. The side walls 22.2 are thus spaced apart from and opposite each other. The first securing part 20 is implemented here as a stamped sheet metal part. It is also conceivable, however, to produce the securing part 20 of plastic, for example as an injection molded part.

A first linear guide element 23 is pivotably connected to the cantilever 22. To this end, the linear guide element 23 comprises a joint segment 23.1 at the end thereof. The joint segment 23.1 is penetrated by a penetration. Holes aligned with each other are made in the side walls 22.2 of the cantilever 22 in the outer region thereof. The penetration of the first linear guide element 23 is aligned with the holes in the side walls 22.2 of the cantilever 22. A pin guided through the holes and the penetration produces the pivotable connection between the first linear guide element 23 and the cantilever 22. A first pivot bearing 24 between the first linear guide element 23 and the cantilever 22 is thus formed. The pivot bearing 24 has a pivot bearing axis.

The first linear guide element 23 is implemented as a bar-shaped slider. Said element is guided in a second linear guide element 33 opposite the joint segment 23.1 thereof on the second securing part 30. To this end, the second linear guide element 33 is made as a hole, here as a through hole, in the second securing part 30. The first linear guide element 23 is inserted into the second linear guide element 33. Said element is thus laterally guided, that is, transverse to the length thereof, and can be displaced linearly in the direction of the length thereof. The first linear guide element 23 and the second linear guide element 33 form the linear guide.

The second securing part 30 comprises a bearing bracket 32 on the sides of which mounting segments 31 are formed. The mounting segments 31 are flange-shaped in design. Said segments are penetrated by cutouts 35. The cutouts 35 have an elongated shape. Said cutouts are oriented transverse to the orientation of the elongated holes 26 in the flanges 21 of the first securing part 20. Contact segments 36 are formed at the ends of the mounting segments 31 of the second securing part 30. As can be seen particularly in FIGS. 3 through 6, the contact segments 36 protrude past a second mounting surface 34 of the second securing part 30.

As shown in FIG. 1, the second linear guide element 33 is formed in the bearing bracket 32 of the second securing part 30.

A guide element 40, which may also be referred to as a pivoting guide element 40, produces an articulated connection between the first and the second securing part 20, 30. The guide element 40 is implemented in the form of a lever. Said element comprises a base segment 41 on which two mounting legs 42 running spaced apart from each other are formed. The mounting legs 42 are oriented in the direction toward the first securing part 20. Axis receptacles 47 are formed on the ends of the mounting legs 42. The two first axis receptacles 47 of the two mounting legs 42 are aligned to each other. The guide element 40 is implemented here as a stamped sheet metal part. The two first axis receptacles 47 are formed by bending the end segments of the mounting legs 42 accordingly. It is also conceivable, however, to implement the first axis receptacles 47 as corresponding holes. The first axis receptacles 47 are disposed at the sides of the side walls 22.2 of the cantilever 22. To this end, the two mounting legs 42 are guided past the sides of the first linear guide element 23, starting from the base segment 41. The side walls 22.2 are each penetrated by a further hole aligned with the first axis receptacles 47. An axis is inserted through said holes and the first axis receptacle 47. A first pivot axis 44 is thus formed between the guide element 40 and the first securing element 10. The first pivot axis 44 is spaced apart from the pivot bearing 24. Mounting tabs 43 are formed on the base segment 41 of the guide element 40 opposite the mounting legs 42 and spaced apart from each other. Second axis receptacles 48 are provide at the ends of the mounting tabs 43. The two second axis receptacles 48 are formed by bending the end segments of the mounting tabs 43 accordingly. It is also conceivable, however, to implement the first second receptacles 48 as corresponding holes. The second axis receptacles 48 are disposed at the sides of the bearing bracket 32 of the second securing part 30. The bearing bracket 32 is penetrated by a hole aligned with the second axis receptacles 48. Said hole runs transverse to the length of the second linear guide element 33. A pin is inserted through the hole and the second axis receptacles 48. A second pivot axis 45 is thereby implemented between the guide element 40 and the second securing part 30.

The pivot bearing 24, the first pivot axis 44, and the second pivot axis 45 are identically oriented.

The mounting legs 42 and part of the base segment 41 implement a contact surface 46.

Figure 2:
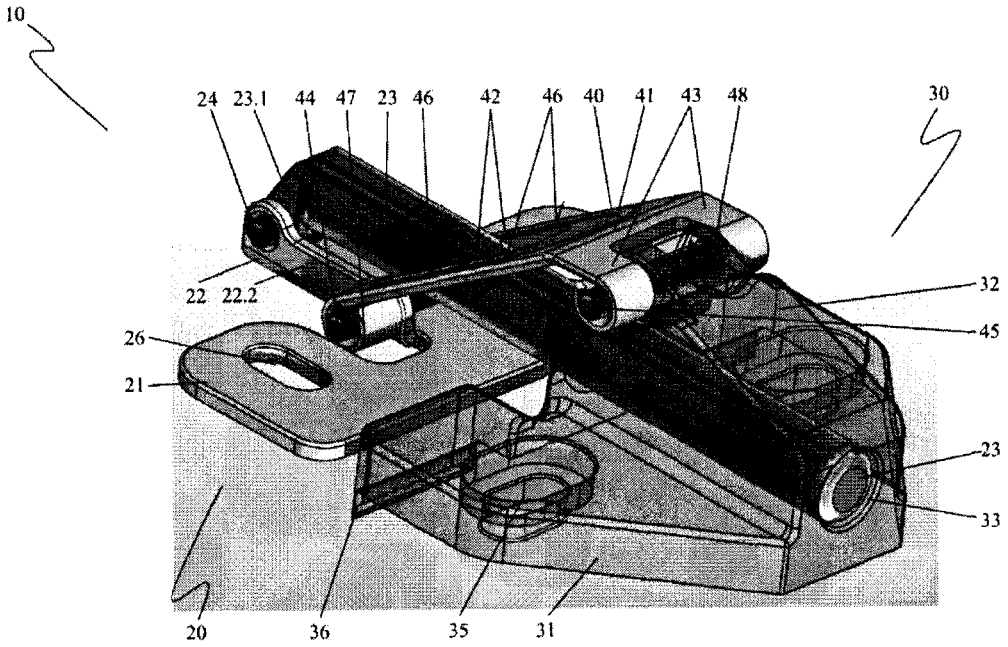

FIG. 2 shows a second perspective view of the hinge 10 shown in FIG. 1 having the linear guide extended. As can be clearly seen in the present representation, the second linear guide element 33 is implemented as a through hole through the bearing bracket 32 of the second securing part 30. The first linear guide element 23 is inserted into the second linear guide element 33 and linearly guided therein.

Figure 3:
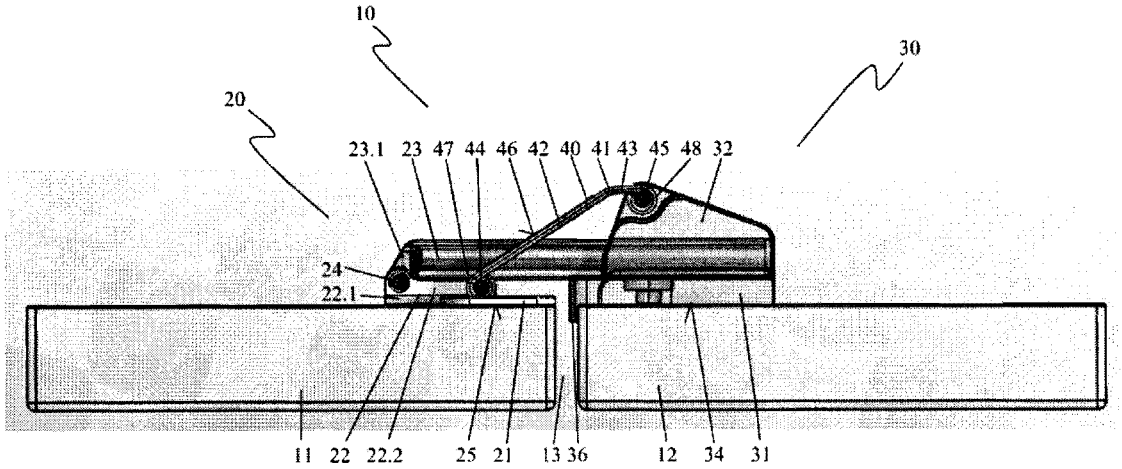

FIG. 3 shows a side view of the hinge 10 shown in FIG. 1 installed on a closed folding flap. A first furniture part 11 thereby forms a first partial flap and a second furniture part 12 forms a second partial flap of the folding flap. In the closed state of the folding flap, the two furniture parts 11, 12 are disposed in one plane. The two furniture parts 11, 12 are thereby spaced apart from each other by a gap 13.

The first securing part 20 is installed on the inner side of the first furniture part 11. To this end, the first mounting surface 25 of the first securing part 20 bears on the inner surface of the first furniture part 11. The first mounting surface 25 is formed by the surfaces of the two flanges 21 facing toward the first furniture part 11, the connecting segment 27, and the floor 22.1 of the cantilever 22. The first securing part 20 is connected to the first furniture part 11 by means of suitable securing means which may also be referred to as fasteners, here by means of screws, not shown, guided through the elongated holes 26 in the flanges 21 of the first securing part 20. The elongated holes 26 enable precise alignment of the first securing part 20 relative to the first furniture part 11 in the displacement direction of the linear guide.

The second mounting surface 34 of the second securing part 30 bears on the inner surface of the second furniture part 12. The formed contact segments 36 thereby enclose the edge of the second furniture part 12 oriented toward the gap 13. The second securing part 30 is thereby precisely aligned relative to the second furniture part 12 in the displacement direction of the linear guide. The second securing part 30 is connected to the second furniture part 12 by means of suitable securing means, here by means of screws, not shown, guided through the cutouts 35 in the mounting segments 31 of the second securing part 30. Because of the elongated design of the cutouts 35, the second securing part 30 can be oriented transverse to the displacement direction of the linear guide.

The gap 13 is selected to be smaller than the width of a finger. The width of the gap 13 is preferably a maximum of 6 mm. The width of the gap 13 is determined by the setting of the linear guide. The setting of the linear guide is defined by the mechanical coupling of the two securing parts 20, 30. Said mechanical coupling is produced here by the guide element 40. The guide element 40 forms a lever. Said element connects the two securing parts 20, 30. To this end, said element is coupled to the first securing part 20 in an articulated manner by the first pivot axis 44, and coupled to the second securing part 30 in an articulated manner by the second pivot axis 45. The guide element 40 intersects the displacement path of the linear guide. The first pivot axis 44 is spaced apart from the pivot bearing 24 of the hinge 10. The first pivot axis 44 is thereby disposed between the pivot bearing 24 and the second securing part 30 in the setting of the hinge shown, wherein the two furniture parts 11, 12 are disposed in one plane. The pivot bearing 24 forms the center of rotation of the hinge 10.

In the setting of the hinge 10 shown in FIG. 3, wherein the two furniture parts 11, 12 are aligned to each other in one plane, the first linear guide element 23 bears on the cantilever 22 in the embodiment example shown, here on the pivot axis of the cantilever 22. A stop of the hinge 10 is thereby implemented. The edge of the furniture part 11 facing the gap 13 thus cannot be pivoted further about the pivot bearing 24 in the direction toward the first linear guide element 23. The orientation of the two furniture parts 11, 12 in one plane thus forms an end position of the pivot range of the hinge 10.

Figure 4:
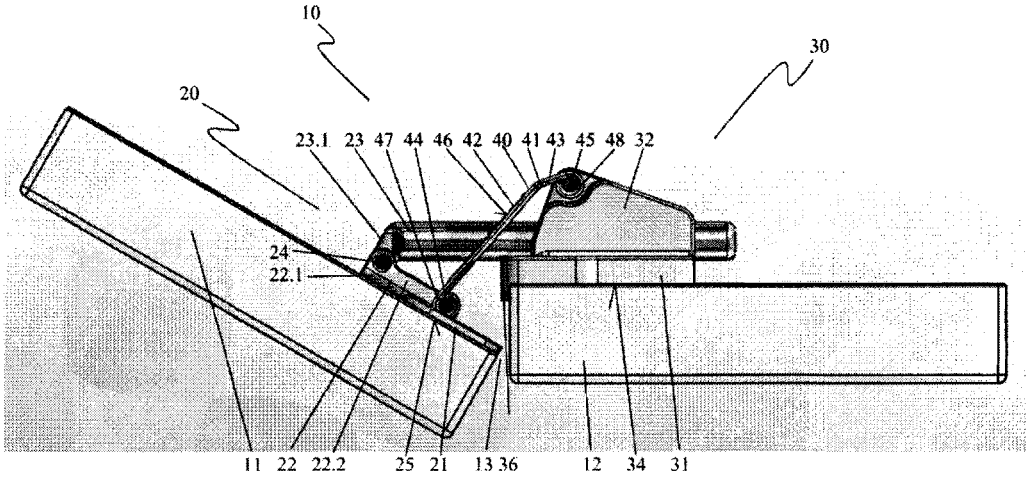

FIG. 4 shows the hinge 10 shown in FIG. 3 having the folding flap partially open. The two furniture parts 11, 12 are thereby pivoted about the pivot bearing 24 of the hinge 10 relative to each other by external actuation, starting from the closed position of the folding flap shown in FIG. 3. Said pivot motion pivots the first pivot axis 44 about the pivot bearing 24. The first pivot axis 44 is mechanically connected by the guide element 40 to the second pivot axis 45 fixed to the second securing part 30. The spacing between the first pivot axis 44 and the second pivot axis 45 is thereby fixedly defined. The first pivot axis 44 is thus also guided on a circular path about the pivot axis 45 by the pivot motion of the actuating parts 20, 30 relative to each other. The simultaneous circular motion of the first pivot axis 44 about the pivot bearing 24 and the second pivot axis 45 requires that the spacing between the pivot bearing 24 and the second pivot axis 45 changes, and is reduced here. The linear guide provides the necessary degree of freedom to this end. The linear guide is thus displaced by the pivoting of the securing elements 11, 12. By actuating the folding flap, the pivot bearing 24 is also pivoted about the first pivot axis 44. At the same time, the pivot bearing 24 is guided on a linear path by the linear guide. The displacing of the linear guide depends on the pivot position of the two securing parts 20, 30 relative to each other. When pivoting the furniture parts 11, 12 and thus the securing parts 20, 30 from the position thereof shown in FIG. 3, wherein the furniture parts 11, 12 are disposed in one plane, into the pivot position shown in FIG. 4, wherein the furniture parts 11, 12 and thus the securing parts 20, 30 are oriented at an angle to each other, the first linear guide element 23 is inserted into the second linear guide element 33. By actuating the hinge 10, the pivot bearing 24 is thus also linearly displaced. The linear displacing thereby takes place due to the orientation of the linear guide parallel to the inner surface of the second furniture part 12 on which the second securing part 30 is installed.

The displacement path of the linear guide depending on the pivot motion of the securing parts 20, 30 relative to each other is defined by the spacing of the pivot bearing 24 and the pivot axes 44, 45 relative to each other. A greater spacing between the pivot bearing 24 and the first pivot axis 44 leads to a greater linear motion of the linear guide for a given pivot motion of the securing parts 20, 30.

The linear displacement of the pivot bearing 24 also linearly changes the position relative to each other of the furniture parts 11, 12 connected to the securing parts 20, 30. The gap 13 implemented between the furniture parts 11, 12 is thereby changed. For known hinge embodiments having rotary axes not linearly displaceably disposed, the gap 13 increases when the hinge is opened, so that a user is able to reach into the gap 13 with the fingers. The fingers can then be pinched when closing such a hinge, potentially leading to severe crushing and thus to injuries due to the large lever formed by the furniture parts 11, 12. Due to the linear displacement of the center of rotation of the hinge 10 according to the invention, the gap 13 remains so small over the entire motion sequence when actuating the hinge 10 that it is not possible to reach through. The gap 13 preferably has a maximum width of 6 mm over the entire pivot range of the hinge 10. Injury to a user can thereby be safely avoided.

It is possible to implement the gap 13 according to an embodiment variant of the invention, not shown, wherein said gap has a gap width changing continuously over the depth thereof as implemented for furniture parts 11, 12 disposed in one plane. For example, the gap 13 can be wedge-shaped in design. To this end, the edges of the furniture parts 11, 12 facing toward each other can be implemented accordingly, or suitably shaped strips and/or surfaces can be disposed at the edges. The inclination of the edges or strips is thereby selected so that the opposing furniture parts 11, 12 do not collide during the pivot motion. Such a design of the gap 13 prevents the gap 13, as shown in FIG. 4, from opening so wide toward the outside in a position of the first furniture parts 11, 12 oriented at an angle to each other that a finger can be partially inserted. The risk of injury can thereby once again be reduced.

Figure 5:
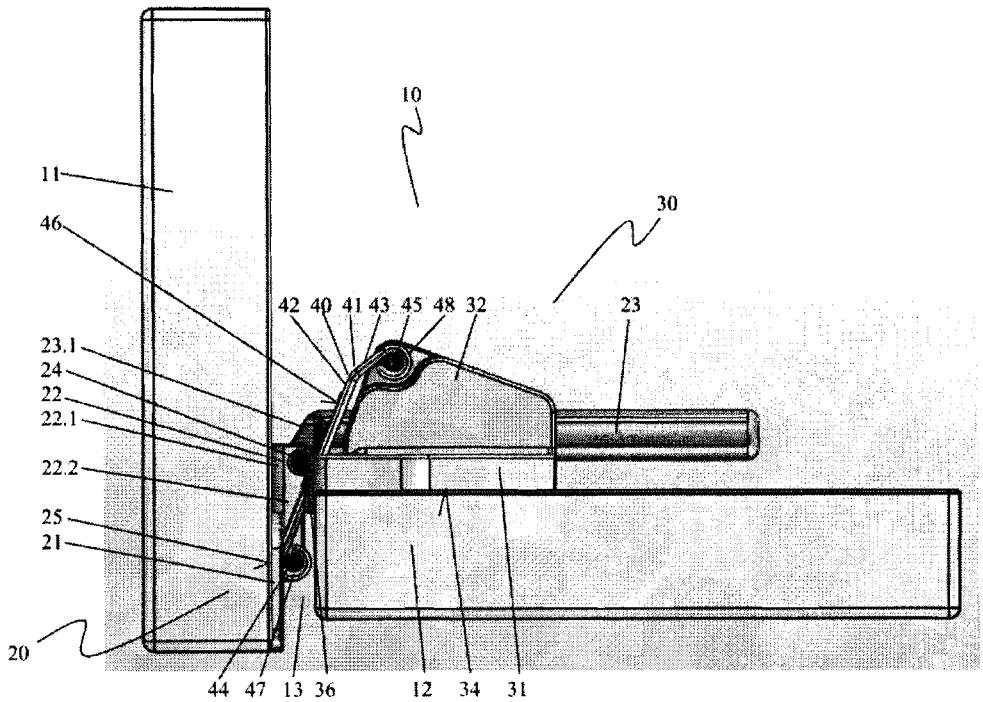

FIG. 5 shows the hinge 10 shown in FIGS. 3 and 4 having the folding flap further open. The furniture parts 11, 12 are oriented at an angle of 90° to each other here. The pivot bearing 24 is drawn tightly against the second securing part 30 by the linear guide. The gap 13, now formed between the edge of the second furniture part 12 and the inner surface of the first furniture part 11, thereby remains so small that reaching through with a finger or a hand is safely prevented. The first pivot axis 44 is pivoted about the pivot bearing 24. Said axis is thus disposed in the gap 13. The guide element 40 has a curved shape. To this end, the mounting legs 42 and the mounting tabs 43 are formed on the base segment 41 at an angle to each other. The second pivot axis 45 is disposed on a region of the bearing bracket 32 of the second securing part 30 disposed as far as possible from the inner surface of the second furniture part 12. The second pivot axis 45 is further provided in a region of the bearing bracket 32 facing toward the first securing part 20. By positioning the second pivot axis 45 spaced apart from the inner surface of the second furniture part 30 and as close as possible to the gap 13, and because of the curved shape of the guide element 40, the mounting legs 42 enter into the gap 13 at an acute angle. The desired small gap width of a maximum of 6 mm is thereby made possible.

Figure 6:
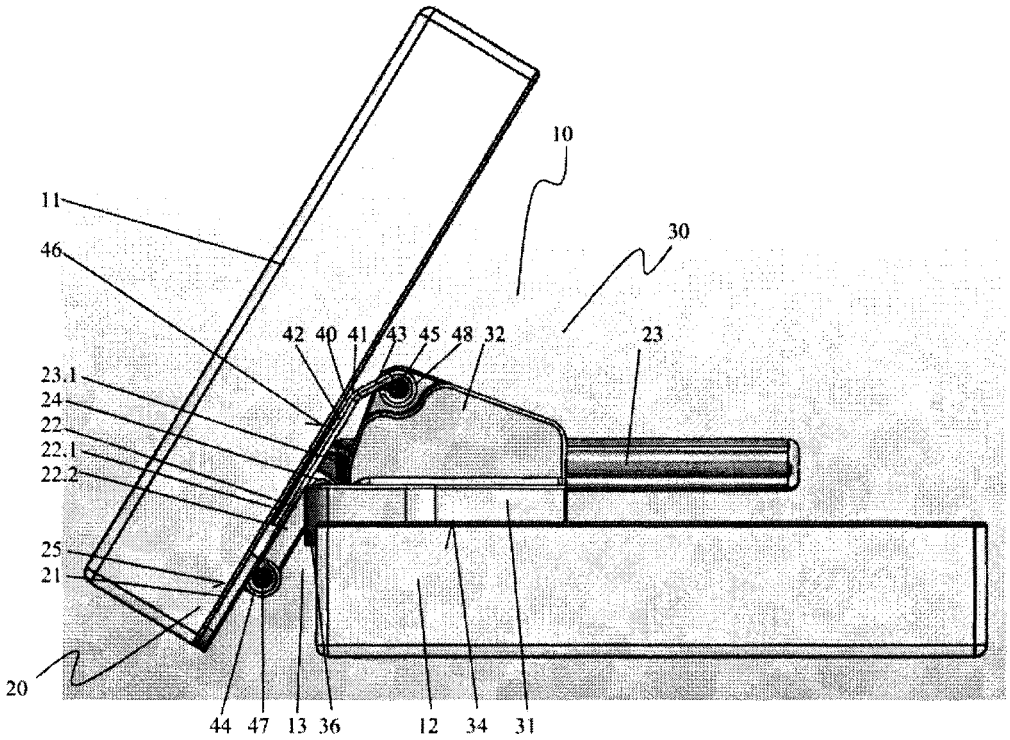

FIG. 6 shows the hinge 10 shown in FIGS. 3, 4, and 5 having the folding flap opened completely. The first furniture part 11 is now pivoted by an angle of greater than 90° relative to the second furniture part 12, starting from the flat orientation of the two furniture parts 11, 12 shown in FIG. 1. The inner surface of the first furniture part 11 bears on the contact surface 46 of the guide element 40. A fixed end position of the pivot motion of the hinge 10 is thereby defined. The pivot bearing 24 is displaced directly against the second securing part 30. The first linear guide element 23 is correspondingly displaced along the second linear guide element 33 implemented as a through hole and protrudes out of the rear side thereof. In the present end position of the hinge 10, the width of the acutely tapered gap 13 is also so small in regions that reaching through with a finger or a hand is safely avoided.

In the embodiment example shown, the linear displacement of the linear guide is brought about by the guide element 40 depending on the pivot setting of the two furniture parts 11, 12 to each other. Other arrangements enabling such a linear displacement depending on the pivot position are also conceivable, however, such as in the form of a gear or gear rack drive, an electric motor drive, or a cable pull, each acting on the linear guide. The embodiment example shown further shows the use of the hinge 10 on a folding flap, wherein the closed state is formed by two partial flaps (furniture parts 11, 12) disposed in one plane. The hinge 10 according to the invention can, however, also be used for other items of furniture, for example in which the closed state is achieved having furniture parts 11, 12 disposed at an angle relative to each other. One such item of furniture, for example, can be a chest having a hinged cover.

The invention claimed is:

1. A hinge for connecting first and second furniture parts pivotable relative to each other, the hinge comprising:

a first securing part configured to be secured to the first furniture part;

a second securing part configured to be secured to the second furniture part;

a linear guide including first and second linear guide elements connected to the first and second securing parts, respectively;

a pivoting guide element including a lever of constant length pivotably connected to the first securing part at a first pivotal axis fixed relative to the first securing part, and to the second securing part at a second pivotal axis fixed relative to the second securing part, the pivoting guide element being configured such that the first and second linear guide elements are linearly displaceable relative to each other depending upon a pivot position of the first and second securing parts relative to each other; and wherein the pivoting guide element and the linear guide are configured such that:

in an extended position of the linear guide the first and second securing parts are pivoted relative to each other such that when the first and second furniture parts are mounted on the first and second securing parts the first and second furniture parts are aligned in one plane; and in a retracted position of the linear guide the first and second securing parts are pivoted relative to each other such that when the first and second furniture parts are mounted on the first and second securing parts the first and second furniture parts are at an angle to each other.

2. The hinge of claim 1, further comprising:

a pivot bearing pivotably connecting the first linear guide element to the first securing part, the pivot bearing being linearly displaceable relative to the second securing part.

3. The hinge of claim 1, wherein:

the first securing part is pivotably connected directly or indirectly to the first linear guide element.

4. The hinge of claim 1, further comprising:

a pivot bearing pivotably connecting the first linear guide element to the first securing part, the pivot bearing having a pivot bearing axis spaced from the first pivot axis.

5. The hinge of claim 4, wherein:

the first pivot axis, the pivot bearing axis, and the second pivot axis are all oriented parallel to each other.

6. The hinge of claim 4, wherein:

the first pivot axis is pivotably disposed about the pivot bearing axis.

7. The hinge of claim 1, wherein:

the linear guide is configured such that the linear guide is oriented parallel to or at least nearly parallel to a surface of the second furniture part connected to the second securing part when the hinge is mounted on an item of furniture.

8. The hinge of claim 1, wherein:

the second securing part includes a mounting surface configured to bear on the second furniture part; and the first pivot axis is disposed to one side of the linear guide toward the mounting surface, and the second pivot axis is disposed to another side of the linear guide away from the mounting surface.

9. The hinge of claim 1, wherein:

at least one of the first and second securing parts includes elongated holes elongated parallel to the linear guide and configured to receive fasteners such that a furniture part secured to the at least one of the first and second securing parts can be adjusted in position parallel to the linear guide.

10. The hinge of claim 1, wherein:

the pivoting guide element includes a contact surface configured to bear on the first furniture part when the first furniture part is secured to the first securing part and the linear guide is retracted.

11. The hinge of claim 1, wherein:

the first linear guide element bears on the first securing part in an end position of a pivot range of the hinge when the linear guide is extended.

12. A method of displacing a first securing part of a hinge in an articulated manner relative to a second securing part of the hinge, the first and second securing parts being configured to be secured to first and second furniture parts, respectively, the method comprising:

pivoting the first securing part relative to the second securing part by pivoting the first securing part about a first pivotal axis fixed relative to the first securing part at one end of a lever of constant length and by pivoting the second securing part about a second pivotal axis fixed relative to the second securing part at a second end of the lever of constant length; and linearly displacing a pivot bearing attached to one of the first and second securing parts depending on a pivot position of the first securing part relative to the second securing part.

13. The method of claim 12, wherein:

the pivot bearing is attached to the first securing part, and when pivoting the first and second securing parts so as to lead to a flat alignment of the first and second furniture parts mounted thereon, a spacing between the pivot bearing and the second securing part is increased, and when pivoting the first and second securing parts so as to lead to a smaller angle between the first and second furniture parts the spacing between the pivot bearing and the second securing part is decreased.

14. The method of claim 12, wherein:

when the hinge is installed on the first and second furniture parts, the linearly displacing of the pivot bearing during relative pivoting of the first and second securing parts is in a direction parallel to a surface of the second furniture part on which surface the second securing part is secured.

15. The method of claim 12, wherein:

the linearly displacing of the pivot bearing during relative pivoting of the first and second securing parts is caused by a mechanical coupling between the first and second securing parts.

16. The method of claim 12, wherein:

the linearly displacing of the pivot bearing depending on the pivot position of the first securing part relative to the second securing part is such that a gap formed between first and second furniture parts connected to each other by the hinge is less than or equal to 6 mm for all pivot positions of the first securing part relative to the second securing part.

* * * * *